US010494248B1

(12) United States Patent
Craven

(10) Patent No.: US 10,494,248 B1
(45) Date of Patent: Dec. 3, 2019

(54) SYSTEM AND METHOD FOR REMOTE TANK ACCESS AND CONTROL

(71) Applicant: James B. Craven, San Antonio, TX (US)

(72) Inventor: James B. Craven, San Antonio, TX (US)

( * ) Notice: Subject to any disclaimer, the term of this patent is extended or adjusted under 35 U.S.C. 154(b) by 166 days.

(21) Appl. No.: 15/706,399

(22) Filed: Sep. 15, 2017

Related U.S. Application Data

(60) Provisional application No. 62/394,868, filed on Sep. 15, 2016.

(51) Int. Cl.

| | |
|---|---|
| ***B67D 7/02*** | (2010.01) |
| ***G06Q 50/00*** | (2012.01) |
| ***B67D 7/32*** | (2010.01) |
| ***B67D 7/78*** | (2010.01) |
| ***B67D 7/70*** | (2010.01) |
| ***B67D 7/74*** | (2010.01) |
| ***B67D 7/62*** | (2010.01) |

(52) U.S. Cl.
CPC ..... *B67D 7/02* (2013.01); *B67D 7/3218* (2013.01); *B67D 7/62* (2013.01); *B67D 7/70* (2013.01); *B67D 7/743* (2013.01); *B67D 7/78* (2013.01); *G06Q 50/00* (2013.01)

(58) Field of Classification Search
CPC ... B67D 7/02; B67D 7/62; B67D 7/70; B67D 7/78; B67D 7/743; B67D 7/3218; C04B 24/36
USPC ..... 141/192
See application file for complete search history.

(56) References Cited

U.S. PATENT DOCUMENTS

| | | | | |
|---|---|---|---|---|
| 3,622,127 | A * | 11/1971 | Burke, Jr. | B01F 5/045 366/148 |
| 3,666,244 | A * | 5/1972 | Nomura et al. | E01C 7/18 366/7 |
| 4,314,921 | A * | 2/1982 | Biegenzein | C08L 95/00 106/281.1 |
| 4,339,277 | A * | 7/1982 | Schult | C08K 3/06 106/275 |
| 4,820,078 | A * | 4/1989 | Brocious | B05B 7/1409 404/111 |
| 5,531,240 | A * | 7/1996 | Kelada | B67D 7/32 137/15.16 |
| 6,824,600 | B2 * | 11/2004 | Bailey | C08L 95/00 106/275 |
| 8,562,789 | B2 * | 10/2013 | Malik | D21H 17/61 162/171 |
| 2008/0314294 | A1 * | 12/2008 | White | C08L 95/00 106/663 |
| 2018/0237289 | A1 * | 8/2018 | Markwardt | G05D 11/132 |

* cited by examiner

*Primary Examiner* — Timothy L Maust
(74) *Attorney, Agent, or Firm* — Pizarro Allen PC

(57) ABSTRACT

A fluid distribution system including an asphalt sealer vessel having an agitator, a water source and an additive vessel remotely controllable so as to permit selective distribution of fluid to a customer vessel.

22 Claims, 2 Drawing Sheets

SYSTEM AND METHOD FOR REMOTE TANK ACCESS AND CONTROL

CROSS-REFERENCE TO RELATED APPLICATION

This application claims priority to U.S. Provisional Patent Application No. 62/394,868 entitled "Method and Apparatus for Remote Tank Access and Control" filed Sep. 15, 2016, which is hereby entirely incorporated herein by reference.

FIELD

The disclosed system and method generally relate to remote access and control of a fluids (including asphalt sealers) mixing and dispensing system.

BACKGROUND

Asphalt sealers used to preserve asphalt surfaces are manufactured as concentrated, viscous fluids. Asphalt sealers may be asphalt-based or coal-tar-based. For commercial applications, such as for parking lots, sealers may be purchased in bulk at a sealer distribution point. At the distribution point, the sealer may be dispensed from a bulk sealer tank into a customer's tank. Water and other additives may then be added to the customer's tank according to various sealer "recipes," and agitated to mix the sealer, water and additives. Additives may include aggregate such as sand, viscosity modifiers, driers, and others.

Distribution points may be storefront operations having one or more employees available to assist a customer with dispensing sealer and adding additives. However, due to lack of suitable workforce or sporadic customer traffic in certain locations, there remains a need for a distribution point or system of distribution points that may be remotely operated.

DETAILED DESCRIPTION

Figure 1:
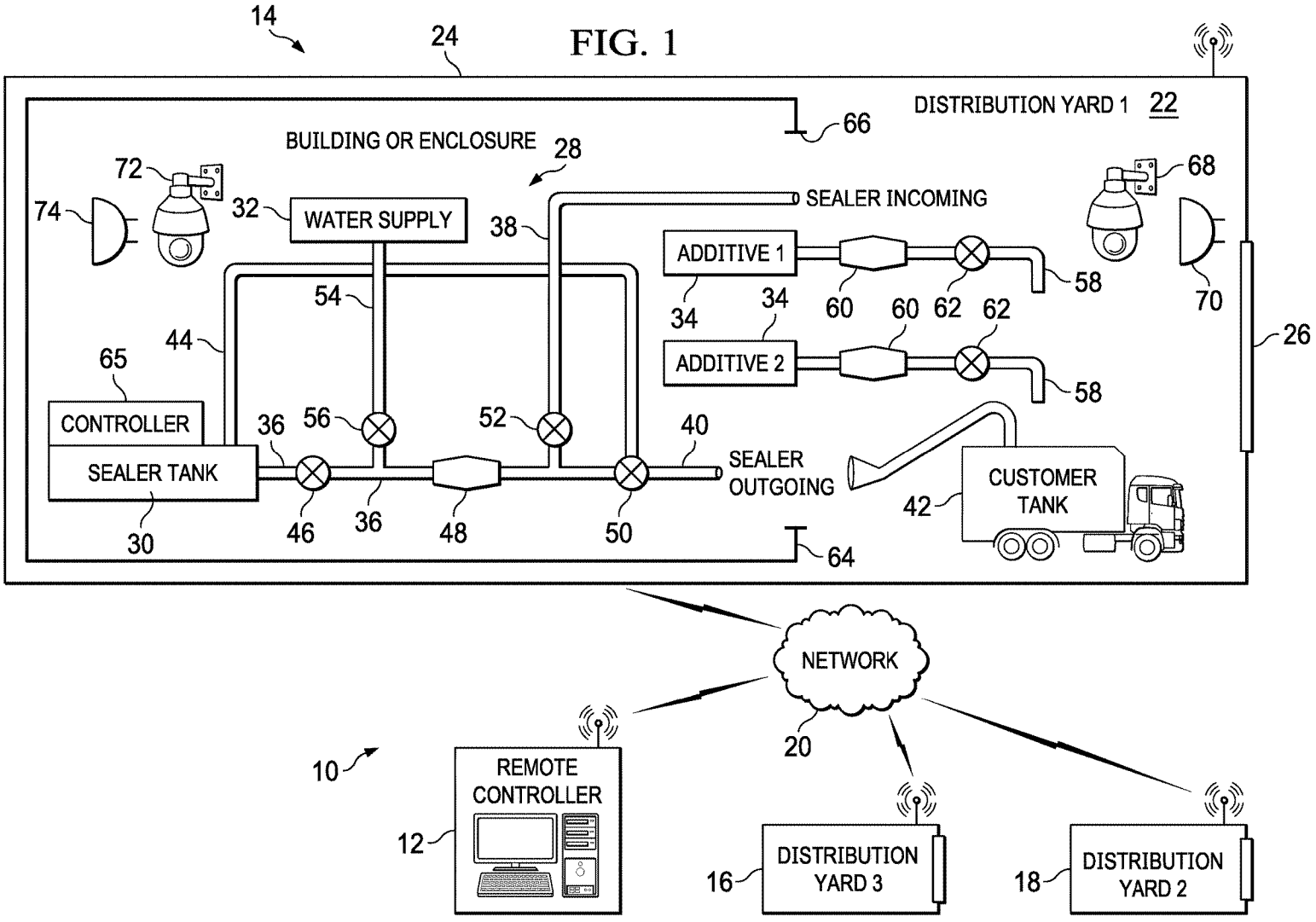
FIG. 1 illustrates one embodiment of a system of distribution points configured for remote operation.

As may be seen in the embodiment of FIG. 1, a remote distribution system 10 may include a remote controller 12 in communication with one or more distribution points 14, 16 and 18 via a network 20. In one embodiment, a distribution point 14 may comprise a distribution yard 22 enclosed by a fence 24. Access into the yard may be provided through a lockable and remotely controllable gate 26. In other embodiments, a distribution point may comprise a building, or a mobile distribution point. A mobile distribution point may, for example, comprise a distribution system mounted to a semi-trailer, ship or railcar, or configured to fit in a shipping container, or provided as a plurality of commercially-shippable modules that may be assembled at a desired location.

A sealer distribution system 28 may include a sealer tank 30, a water supply 32 and one or more additive vessels tanks 34. A sealer tank conduit 36 may allow sealer to flow into and out of from the sealer tank. An inlet conduit 38 may be provided to allow filling of the sealer tank from a bulk sealer transport vehicle, such as a tanker truck. An outlet conduit 40 may allow sealer to flow from the sealer tank to a customer container 42, such as a tank or other vessel. Such a container may be mounted on a trailer, truck, train car, or other mode of transportation. A recycle conduit 44 may allow sealer to be circulated from the sealer tank conduit back into the sealer tank.

The sealer tank conduit 36 may be provided with a remotely-operable supply valve 46 to permit or prevent sealer from flowing into or out of the sealer tank 30. A pump 48 may be used to move fluid through the sealer tank conduit 36 at a desired flow rate. The pump 48 may be reversible to allow movement of fluid into the sealer tank 30, such as from a bulk supply truck, or from the sealer tank to a customer's vessel. Alternately, each flow path, such as additive piping, incoming sealer, outgoing sealer, water supply, and any other fluid lines may have a pump exclusive to that flow path.

A flow meter (not shown) may be disposed in the sealer tank conduit 36 to detect the volume of fluid moving through the sealer tank conduit 36. A strainer (not shown) may also be provided upstream (which may depend on direction of fluid flow) of the pump 48 to catch debris before the fluid reaches the pump. The pump 48 may draw sealer from the sealer tank 30 and move it through the outlet conduit 38 so as to dispense the sealer into a customer vessel. The pump 48 may draw water, or additives so as to dispense them into a customer vessel according to recipe.

Additionally, a strainer (not shown) may be disposed in the incoming sealer conduit 38 so as to prevent outside contamination, such as sediment and debris, from entering the system. A strainer (not shown) may also be disposed in the outgoing sealer conduit 40 to ensure that the customer receives sealer containing the minimal amount of debris and sediment as possible.

In some embodiments, fluid may be diverted from the sealer tank conduit 36 to the recycle conduit 44 by operation of a remotely operable three-way valve 50. The recycle conduit 44 may be useful for clearing the sealer tank conduit 36, such as for cleaning out the strainer, or for circulating sealer that has been sitting in the sealer tank conduit 36 for longer periods of time.

As noted above, the pump 48 may also operate to draw sealer from a bulk supply truck into the inlet conduit 38, and move the sealer through the sealer tank conduit 36 into the tank 30. The pump 48 may advantageously comprise a positive displacement fluid pump rather than an air diaphragm pump. A remotely operable shutoff valve 52 may be used to prevent fluid from flowing through the inlet conduit 38.

A water supply conduit 54 may be sealingly connected from a water supply 32 to the sealer tank conduit 36. The water supply 32 may comprise any suitable clean water source, such as a well, an on-site tank, or municipal water connection. A remotely operable shutoff valve 56 may be used to prevent fluid from flowing through the water supply conduit 54. In some embodiments, the supply valve 46 and shutoff valve 56 may comprise a single three-way valve. If the water supply is not pressurized, then a water pump (not shown) may be used to move water from the water supply to the sealer tank conduit. Water may be introduced into the sealer tank conduit 36 in order to flush out said conduit. Water may also be introduced into the sealer tank conduit 36 in order to provide water to the sealer mix. In some embodiments, the valve 46 may be closed and water may be forced through the sealer tank conduit 36 as the primary fluid. In other embodiments, the valve 46 may be open and water may be added to the sealer as it moves through the sealer tank conduit 36. Valve 56 may be so configured at to allow the metering of water into sealer conduit 36. Such a configuration may allow a particular desired ratio of water to sealer. Such metering may be controllable to adjust said ratio to the needs of a customer or other system user.

Figure 2:
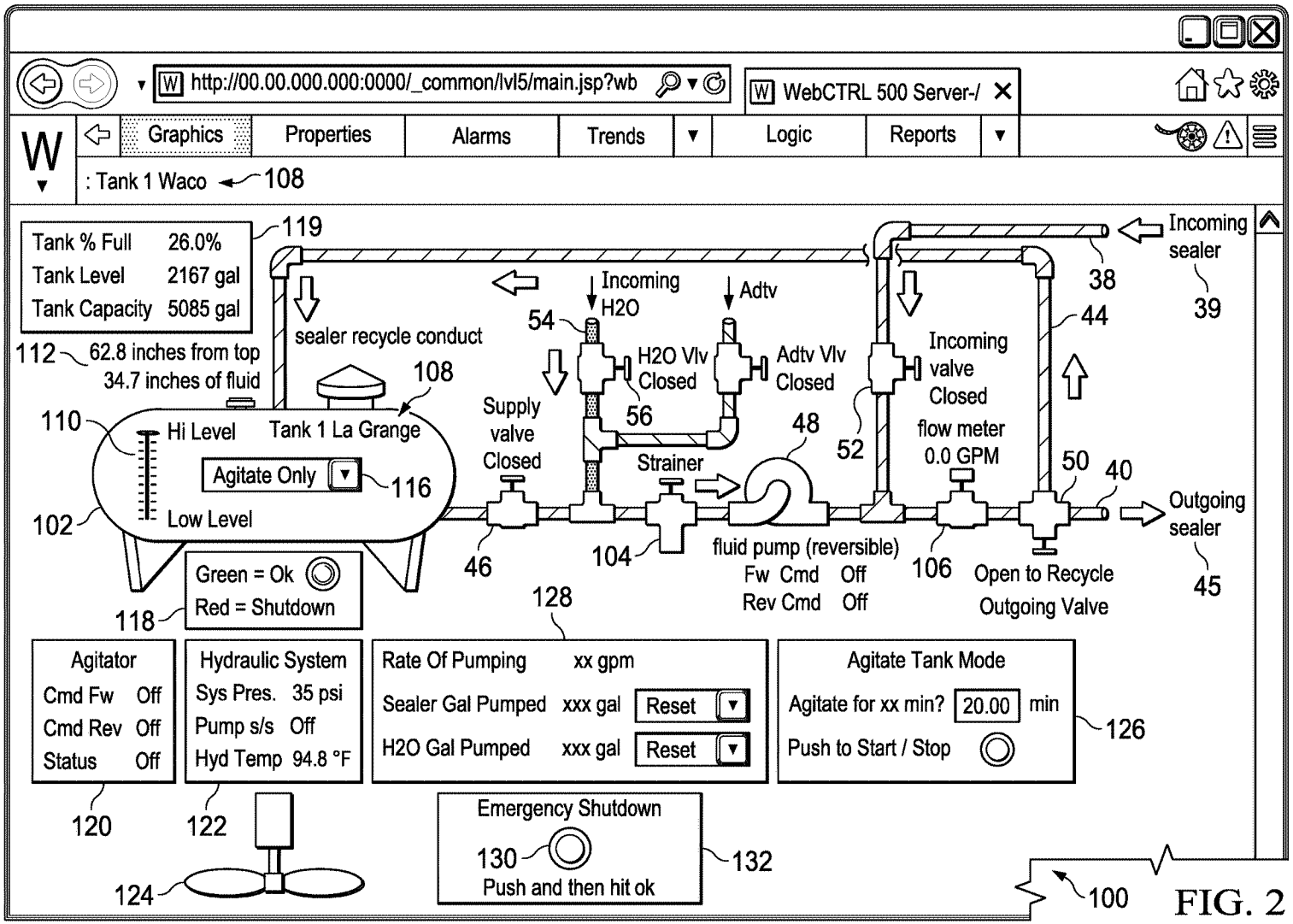
FIG. 2 illustrates one embodiment of a control user interface.

One or more additives may be remotely dispensed into a customer tank 42. The one or more additives may be provided in one or more additive vessels 34. Each additive may be introduced via additive conduits 58 into the sealer tank conduit 36 or outgoing conduit 40 in the manner of water from the water supply (as shown in FIG. 2), or may be provided via an additive conduit 58 directly into the customer tank (as shown in FIG. 1). Additive flow through the additive conduits 58 may be controlled by a remotely-operable pump 60 and/or remotely-operable shut-off valve 62.

Various valve and conduit configurations may be provided so as to optimally control fluid flow and fluid ratios, such as to better control volume flow or increase precision of fluid mixture ratios. In another embodiment, the valve 52 may be replaced with a 3-way valve disposed at the tee-intersection of incoming conduit 38 and sealer tank conduit 36. In other embodiments, valves 50 and 52 may be replaced with a 4-way valve disposed at an intersection of the sealer conduit 36, recycle conduit 44, incoming sealer conduit 38, and outgoing sealer conduit 40. And in yet another embodiment, valves 46 and 56 may be replaced with a 3-way valve at the tee-intersection of sealer conduit 36 and water supply conduit 54. Furthermore, secondary or bypass conduits, valves and relays may be provided for backup should main conduits and valves fail.

The sealer tank may have sensors disposed therein to detect the hydraulic pressure and temperature of sealer in the sealer tank. The sealer tank may also have an agitator rotatably disposed therein to allow selective agitation of the sealer in the sealer tank. The agitator may comprise one or more paddles that rotate along the length of the sealer tank. The agitator may be hydraulically or electrically activated. Activation and speed of the agitator may be remotely controlled. The agitator may further include sensors that detect agitator speed, temperature, and strain. A timer (not shown) may be used to control how long an agitator is activated.

An on-site master shut-off button (not shown) may be provided in a place convenient for a customer to access. An on-site customer may press the shut-off button at any time to stop the sealer distribution system for safety reasons or any other reason.

The sealer distribution system may be enclosed by a building 64 having a lockable and remotely controllable door 66. The distribution yard may be monitored by a pan-tilt-zoom security camera 68 having a microphone 70. The building may be separately monitored by a pan-tilt-zoom security camera 72 having a microphone 74. The cameras and microphones may be used to allow a remote operator to see and hear customer activity, as well as see and hear system operation. For example, the remote operator may visually verify that the agitator is turning. If the agitator is not actually turning despite system activation, then the operator may determine that an agitator may be broken, possibly destroying a tank.

The sealer distribution system may be controlled by a distribution controller 65 electrically connected to various pumps, relays, valves, sensors, flow meters, gates, cameras and microphones of the distribution point 14. Relays may be used to control various electrical devices, and advantageously comprise an electromagnetically operated rather than electronic open collector switches for robustness. Material meters may advantageously comprise magnetic meters rather than mechanical meters for reliability.

The controller 65 may comprise an electronic circuit, router and telecommunications capability. The controller 65 may be part of any suitable building or equipment automation system, such as Allen Bradley, National Instruments, or the WebCTRL system made by Automated Logic. The distribution controller 65 may communicate with a remote controller 12 over a network 20.

All devices and components may be provided from commercially available sources to facilitate speedy repair. In some embodiments, fluid flows may be controlled by means of motorized ball valves. The actuator of the foregoing valves may be pneumatic, electronic, hydraulic, or modality as known to one skilled in the art. Additionally, remotely operated valves and other equipment may carry secondary manual controls for events in which on-site control may be required or in case of remote actuation failure.

Onboard dry contact position switches may be used to supply position logic to circuit boards. The circuit boards deliver the logic to the automation software for processing and display on the graphical interface. At any time, the operator may determine whether a valve is open or closed. Viewing the device gives the operator independent confirmation of any valve's position. Software logic may be used to operate each valve and references its position switch. If the position switch is incorrect, the routine may be suspended. The goal is to control the flow path of sealer through the system and ensure that the desired flow path is realized by the system. For example, a desired flow path may be to the outgoing sealer conduit so as to fill a customer's designated vessel. A goal of the system is thus to deliver sealer to the customer's vessel and to no other possible endpoint in the system.

The remote controller 12 may comprise a server having conventional automation software installed therein. The server may provide a browser based user interface to a human operator using a suitable client computer. The human operator may interact with the user interface using any suitable I/O device, such as a mouse or keyboard. One example of such a user interface is illustrated in FIG. 2. The graphical interface may display the various inputs from hydraulic, thermal, analog and digital sensors. The operator may observe the system's temperature, hydraulic pressure, and tank level. Rate of flow, volumes of products pumped, and totalized volumes dispensed may also be displayed. Data points may be displayed in appropriate units of measure, such as flow rates in gallons per minute and volumetric data in gallons. Such data may be seen as graphic displays, or numerical values, depending on the operator or user device.

Additionally, the browser based interface may be accessed on smartphones, tablets, laptop computers, or any other device that may support web-browser functions. The interface may be enabled on a single device at a time or multiple devices concurrently. The facility operator may be able to select what device types and even which individual nodes, devices, and terminals may be allowed access at a given time. This function may be beneficial in emergency situations, equipment failures, maintenance operations, and other events in which control of the system may need to be limited to designated personnel, such as the remote operator, a technician, engineer, maintenance worker or other such authorized individual.

As may be seen in FIG. 2, a sealer distribution system may be represented on a screen 100. Depending on the configuration of the sealer distribution system, various conduits and equipment may be displayed. For example, the screen 100 may display a sealer tank 102 and the various conduits through which sealer, water and additives may flow, such as the inlet conduit 38 for incoming sealer 39, water supply conduit 54, the recycle conduit 44 and the outlet conduit 40 for outgoing sealer 45. The screen may show the relative location, type and status of various system equipment. In the embodiment depicted in FIG. 2, the screen shows the supply valve 46 as closed, the water valve 56 as closed, the pump 48 as off, the three-way valve 50 as closed, and the incoming sealer valve 52 as closed. The location of a strainer 104 may be displayed so as to allow the operator to see where the strainer is situated with respect to the other system equipment. The screen 100 may also indicate the rate of fluid flow through the flow meter 106. The screen 100 may also indicate the name and/or location 108 of the system. The status of power to the system may be represented by any suitable symbol, such as a fan symbol 124.

Additional visual cues and information may be provided through a color coding system. In such a system, sealer conduits may be green in appearance, while water conduits appear blue, and additive conduits appear pink. These colors are exemplary and any color may be selected to represent a sub-system or conduit network. The color coding system may allow an operator to visually identify a specific conduit network with speed and ease. Such rapid identification may be essential in emergency or failure situations. In addition to sub-system designation, these colors may also pulse, oscillate, glow, twinkle, or display other visual cues to indicate flow through a conduit. Arrows disposed along the conduit icons may constitute another mode of visual cue. Said arrows may only be visible when a flow is detected in the associated conduit and said arrows may change in shape and direction to represent flow velocity of the fluid in the conduit.

For example, a sealer conduit with no flow may appear as a uniform green color, yet same said conduit seeing a flow event may pulse to indicate the flow event. Even further, a conduit may appear gray with the properly associated sub-system color as an outline to indicate lack of product in the line, whereas a conduit holding static (non-flowing) product may appear as a solid shade of the appropriate sub-system designated color.

Information from various equipment and sensors may be processed and displayed. For example, the screen may display the level 110 of sealer in the sealer tank 30. The calculated level 112 of sealer in the sealer tank 30 may also be displayed. Similarly, given the dimensions of the tank 30, the volume data 119 of sealer in the sealer tank 30 may be displayed. Said information, any operator inputs, and any other pertinent data points may be recorded and stored. Such data may be used for training, system efficiency evaluation, process evaluation, personnel performance evaluation, post-incident investigation activities, and any other business and engineering functions wherein the data may be of benefit.

The system mode may be remotely selected by an operator from an on-screen menu 116. For example, an operator may select "Agitate Only" to activate only the sealer tank agitator, "Automatic Pumping" to activate the sealer pump and related equipment for a certain length of time or volume of sealer, water and additives to achieve a desired sealer mix, "Pumping No Agitate" for activating the sealer pump without activating the agitator, "Recycle Sealer" for activating the recycle loop and opening the recycle valve 50, "Sealer Refill" for opening the incoming sealer valve 52 and activating the pump to move sealer into the sealer tank, "Rinse" to inject water from the water supply in to the sealer tank conduit, "Add Additive 1" to add a first additive, such as latex, "Add Additive 2" to add a second additive such as aggregate, and "Manual Control" to allow an operator to individually control the operation of the system equipment, or similar designations for such modes.

A status light 118 may be provided to indicate the status of the agitator. The activity status 120 of the agitator may be displayed, and certain operating conditions 122 of an agitator hydraulic actuator may also be displayed, such as pressure, temperature. The agitator may be operated for a set period of time 126, and activated by a button displayed on the screen. In some embodiments, the status of the agitator may be used as a threshold criterion to determine whether the system may be used. If the agitator may be activated and controlled by the actuator, and the human operator may see via camera that the agitator actuator is operating properly, then the operator may proceed to operate the remaining equipment in the system.

Fluid flow 128 may also be displayed, such as the rate of sealer pumping, the volume of sealer pumped and the volume of water pumped and the volume of any additive pumped, and the weight or volume of aggregate dispensed.

Other user screens may be provided to display a representation of the building and distribution yard. The user screens may allow remote operation of building door locks, yard fence gates, monitor open/closed status of doors, gates and locks, and control and reset cameras and microphones.

Still further screens may allow the operator to set and view various system properties, system alarms, operational trends, operation logic, and operational reports. For example, the remote controller may record the actions that an operator takes via the user interface, and provide reports regarding operator actions and operation timeline. In some embodiments, an operator or system administrator may play back a video or animation of actions taken via the user interface, thus permitting review of operator actions. Such review can permit an operator to better learn how to operate the system, to determine the source of program or operator error, or to program operation logic.

The system may be designed to handle an internet communication failure. Each remote operator command may be delivered and executed as a discrete, defined routine. This batch processing helps eliminate the possibility of the system continuing to dispense fluid or additives uncontrollably. Any other failure that could result in lack of control is mitigated by an emergency kill button (not shown) at the tank site, and a kill button 130 on the operator's interface with instructions 132 for use. Either the customer or the operator may immediately stop any operation using the kill button. The kill button may also be reset from the remote controller or by the customer on-site.

Thus, the system allows an operator to remotely monitor and control bulk fluid storage tank operations by means of an arrangement of fluid flow devices, electronic circuits, electronic devices, hydraulic circuits, hydraulic devices, software programming, and video surveillance. Redundant monitoring, discrete programming, elegant design, and map and graphical interfacing may be provided for security, robustness and ease of use.

In operation, a customer may arrive at the distribution yard, and call the remote operator. The customer may tell the operator that he wants a certain number of gallons of sealer, a certain number of gallons of water, a certain number of gallons of a first additive (such as latex), and a certain number pounds of a second additive (such as aggregate). He may then give the operator his debit or credit card information, or specify some other payment form, and place the outlet conduit into his tank. Depending on system configuration, the customer may also place an additive outlet conduit in his tank.

The remote operator may have already logged onto the system so as to place the sealer distribution system under remote control. The remote operator may control the system to run a small amount of water through the system and into the customer's vessel. Running water through the system as an initial step may pre-prove operation of various system components, and help maintain the system by a short cleansing.

The operator may then enter the number of sealer gallons required, and initiate the system to dispense sealer from the sealer tank by opening and closing valves as required to move sealer from the sealer tank to the outlet conduit, and activating the pump.

Simultaneously, the operator may observe the entire process by means of video surveillance and the PTZ cameras (which may be capable of night vision and preferably at least 10× magnification). A digital video recorder may provide an audio/visual record of the system and customer activity at the distribution point. The operator, not the customer, may thus control the process.

After the sealer is dispensed, the operator may flush the system again with a small amount of water; then the first additive is dispensed; then the second additive. Finally, the balance of the required water may be dispensed. The customer may then remove the outlet conduit from the tank, and leaves. In certain installations, the operator may open and close the yard gate and building door to give the customer access to the tank site. This may facilitate after-hours operations.

In some embodiments, the remote distribution system 10 may comprise a client-server architecture. Of course, the system 10 may comprise more than one remote controller/server and/or client. In other embodiments, the system 10 may comprise other types of network architecture, such as a peer-to-peer architecture, or any combination or hybrid thereof.

The remote controller server may comprise one or more computers or programs that respond to commands or requests from one or more other computers or programs controlled by an operator, or clients. The clients may comprise one or more computers or programs that issue commands or requests for service provided by one or more other computers or programs, or servers. The servers and clients may be located in or across one or more computers and/or geographic locations. Servers and/or clients may variously be or reside on, for example, mainframe computers, desktop computers, PDAs, smartphones, tablets, netbooks, portable computers, portable media players with network communication capabilities, cameras with network communication capabilities, wearable computers, point of sale devices, and the like.

A computer may be any device capable of accepting input, processing the input according to a program, and producing output. A computer may comprise, for example, a processor, memory and network connection capability. Computers may be of a variety of classes, such as supercomputers, mainframes, workstations, microcomputers, and PDAs, according to the computer's size, speed, cost and abilities. Computers may be stationary or portable, and may be programmed for a variety of functions, such as cellular telephony, media recordation and playback, data transfer, web browsing, data processing, data query, process automation, video conferencing, artificial intelligence, and much more.

A program may comprise any sequence of instructions, such as an algorithm, whether in a form that can be executed by a computer (object code), in a form that can be read by humans (source code), or otherwise. A program may comprise or call one or more data structures and variables. A program may be embodied in hardware or software, or a combination thereof. A program may be created using any suitable programming language, such as C, C++, Java, Perl, PHP, Ruby, SQL, and others. Computer software may comprise one or more programs and related data. Examples of computer software include system software (such as operating system software, device drivers and utilities), middleware (such as web servers, data access software and enterprise messaging software), application software (such as databases, video games and media players), firmware (such as software installed on calculators, keyboards and mobile phones), and programming tools (such as debuggers, compilers and text editors).

Memory may comprise any computer-readable medium in which information can be temporarily or permanently stored and retrieved. Examples of memory include various types of RAM and ROM, such as SRAM, DRAM, Z-RAM, flash, optical disks, magnetic tape, punch cards, EEPROM. Memory may be virtualized, and may be provided in or across one or more devices and/or geographic locations, such as RAID technology.

An I/O device may comprise any hardware that can be used to provide information to and/or receive information from a computer. Exemplary I/O devices include disk drives, keyboards, video display screens, mouse pointers, printers, card readers, scanners (such as barcode, fingerprint, iris, QR code, and other types of scanners), RFID devices, tape drives, touch screens, video cameras, still cameras, movement sensors, network cards, storage devices, microphones, audio speakers, styli and transducers, and associated interfaces and drivers.

The network 20 may comprise a cellular network, the Internet, intranet, local area network (LAN), wide area network (WAN), Metropolitan Area Network (MAN), other types of area networks, cable television network, satellite network, telephone network, public networks, private networks, wired or wireless networks, virtual, switched, routed, fully connected, and any combination and subnetwork thereof. The network may use a variety of network devices, such as routers, bridges, switches, hubs, repeaters, converters, receivers, proxies, firewalls, translators and the like. Network connections may be wired or wireless, and may use multiplexers, network interface cards, modems, IDSN terminal adapters, line drivers, and the like. The network may comprise any suitable topology, such as point-to-point, bus, star, tree, mesh, ring and any combination or hybrid thereof.

Communication in and among computers, I/O devices and network devices may be accomplished using a variety of protocols. Protocols may include, for example, signaling, error detection and correction, data formatting and address mapping. For example, protocols may be provided according to the seven-layer Open Systems Interconnection model (OSI model), or the TCP/IP model.

Although the disclosed subject matter and its advantages have been described in detail, it should be understood that various changes, substitutions and alterations can be made herein without departing from the invention as defined by the appended claims. Moreover, the scope of the claimed subject matter is not intended to be limited to the particular embodiments of the process, machine, manufacture, composition, or matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods or steps.

What is claimed is:

1. A fluid distribution system comprising:

an asphalt sealer vessel comprising a motorized agitator capable of activation by an agitator relay;

a first motorized ball valve in sealed communication with the sealer vessel so as to selectively release or prevent flow of sealer from the sealer vessel, the first motorized ball valve being monitored via first dry contact position switches configured to provide first position data;

a second motorized ball valve in sealed communication with a water source so as to selectively release or prevent flow of water from the water source, the second motorized ball valve being monitored via second dry contact position switches configured to provide second position data;

a first remotely-operable pump in selective sealed fluid communication with the sealer vessel through the first motorized ball valve and with the water source through the second motorized ball valve;

an outlet conduit having a first end and a second end, the first end being in sealed connection to the first remotely-operable pump, and the second end being configured for conveying fluid to a customer vessel;

an additive vessel configured for conveying additive to the customer vessel;

a third motorized ball valve in sealed communication with the additive vessel so as to selectively release or prevent flow of additive from the additive vessel, the third motorized ball valve being monitored via third dry contact position switches configured to provide third position data;

a remote controller configured to receive first position data from the first dry contact position switches, receive second position data from the second dry contact position switches, receive third position data from the third dry contact position switches, operate the first motorized ball valve according to the first position data, operate the second motorized ball valve according to the second position data, operate the third motorized ball valve according to the third position data, and operate the first remotely-operable pump to dispense sealer from the sealer vessel out through the outlet conduit, the remote controller further configured to verify that the agitator is actuatable by the relay prior to operation of the first motorized ball valve or first remotely-operable pump.

2. The fluid distribution system of claim 1, wherein the additive vessel is in selective sealed fluid communication with the first remotely-operable pump through the third motorized ball valve.

3. The fluid distribution system of claim 2, further comprising a recycle conduit in selective sealing communication at a first end with the sealer vessel and at a second end with the first remotely-operable pump through a fourth motorized ball valve.

4. The fluid distribution system of claim 3, further comprising a strainer disposed so as to filter fluid flowing to the first remotely-operable pump.

5. The fluid distribution system of claim 4, further comprising:

a sealer sensor disposed so as to monitor the weight or volume of sealer in the sealer vessel, the sealer sensor configured to transmit sealer weight or sealer volume data to the remote controller;

an additive sensor disposed so as to monitor the weight or volume of additive in the additive vessel, the additive sensor configured to transmit additive weight or additive volume data to the remote controller.

6. The fluid distribution system of claim 5, further comprising:

a flow meter in sealed fluid communication with the first remotely-operable pump, the flow meter configured to provide flow data;

an outlet conduit having a first end and a second end, the first end being in sealed connection to the flow meter, and the second end being configured for conveying fluid to a customer vessel.

7. The fluid distribution system of claim 6, further comprising a distribution controller configured to receive and convey to the remote controller the first position data from the first dry contact position switches, the second position data from the second dry contact position switches, the third position data from the third dry contact position switches, the sealer weight or sealer volume data the flow data, the additive weight or additive volume data, and the flow data; and to receive instructions from the remote controller to operate the first motorized ball valve according to the first position data, operate the second motorized ball valve according to the second position data, operate the third motorized ball valve according to the third position data, and operate the first remotely-operable pump to dispense sealer from the sealer vessel out through the outlet conduit.

8. The fluid distribution system of claim 7, further comprising a graphical user interface generated by the remote controller, the graphical user interface displaying a representation of, and one or more fluid paths between, at least two of the sealer vessel, first motorized ball valve, second motorized ball valve, first remotely-operable pump, outlet conduit, additive vessel, third motorized ball valve, recycle conduit and strainer.

9. The fluid distribution system of claim 8, further comprising an emergency shut-down switch remotely controllable by the remote controller, the graphical user interface further displaying a representation of an emergency shut-down button by which an operator may actuate the emergency shut-down switch.

10. The fluid distribution system of claim 9, the agitator relay remotely controllable by the remote controller, the graphical user interface further displaying a selectable command by which an operator may actuate the agitator relay.

11. The fluid distribution system of claim 10, the graphical user interface further displaying the level of sealer in the sealer vessel, the status of the agitator, the rate of fluid flow, the status of the first, second and third motorized ball valves.

12. The fluid distribution system of claim 11, further comprising:

a structure accessibly enclosing the second end of the outlet conduit, the structure comprising a door that may be selectively locked and unlocked by the remote controller;

a first PTZ camera disposed within the structure and configured to transmit first video data to the remote controller so as to allow an operator to remotely view the sealer vessel; and a first microphone disposed within the structure and configured to transmit first audio data to the remote controller so as to allow an operator to remotely hear the activity of a customer.

13. The fluid distribution system of claim 12, the structure comprising one of a building, a shipping container, a shippable module, a semi-trailer, a railcar, and a boat.

14. The fluid distribution system of claim 13, the structure comprising a building enclosed by a fence having a gate that may be selectively opened and closed by the remote controller; the system further comprising:

a second PTZ camera disposed outside the structure and configured to transmit second video data to the remote controller so as to allow an operator to remotely view the sealer vessel; and a second microphone disposed within the structure and configured to transmit second audio data to the remote controller so as to allow an operator to remotely hear the activity of a customer.

15. The fluid distribution system of claim 1, further comprising:

a second remotely-operable pump in selective sealed fluid communication with the additive vessel through the third motorized ball valve, the remote controller configured to operate the second remotely-operable pump to dispense additive from the additive vessel to the customer vessel.

16. The fluid distribution system of claim 1, the additive comprising one of an aggregate, a sand, a viscosity modifier and a drier.

17. A method of distributing fluid, the method comprising:

remotely determining an amount of asphalt sealer in an asphalt sealer vessel, the asphalt sealer vessel comprising a motorized agitator capable of actuation by an agitator relay;

verifying that the motorized agitator is actuatable by the agitator relay;

after verifying that the motorized agitator is actuatable, remotely activating a first motorized ball valve so as to selectively release or prevent flow of sealer from the sealer vessel to a mobile tank;

after verifying that the motorized agitator is actuatable, remotely activating a first remotely-operable pump, the first remotely-operable pump being in selective sealed fluid communication with the sealer vessel through the first motorized ball valve and with a first additive source through a second motorized ball valve; and remotely activating the second motorized ball valve, the second motorized ball valve being in sealed communication with the first additive source so as to selectively release or prevent flow of first additive from the first additive source to the mobile tank.

18. The method of claim 17, further comprising:

remotely determining the amount of a second additive in a second additive vessel; and remotely activating a third motorized ball valve, the third motorized ball valve being in sealed fluid communication with the second additive vessel so as to selectively release or prevent flow of the second additive from the second additive vessel to the mobile tank.

19. The method of claim 18, further comprising remotely activating a fourth motorized ball valve so as to direct sealer from the first remotely operable pump back to the sealer vessel through a sealed conduit.

20. The method of claim 19, further comprising remotely monitoring the level of sealer in the sealer vessel, the status of the agitator, a rate of fluid flow, and the status of at least one of the first, second, third and fourth motorized ball valves.

21. The method of claim 20, further comprising selectively releasing sealer and the first additive or a second additive, or both the first additive and the second additive, to mix according to a predetermined ratio.

22. The method of claim 21, wherein the first additive is water.

* * * * *